United States Patent [19]

Kitamura et al.

[11] Patent Number: 5,008,001

[45] Date of Patent: Apr. 16, 1991

[54] PROCESS FOR HYDROGENATION OF HEAVY OIL

[75] Inventors: Toru Kitamura; Yoshio Ohashi; Masami Sekino; Kenichi Murakawa, all of Sodegaura, Japan

[73] Assignee: Research Association for Petroleum Alternatives Development, Tokyo, Japan

[21] Appl. No.: 224,067

[22] Filed: Jul. 25, 1988

[30] Foreign Application Priority Data

Aug. 3, 1987 [JP] Japan ..... 62-192702
Mar. 7, 1988 [JP] Japan ..... 63-51551

[51] Int. Cl.[5] ..... C10G 45/00

[52] U.S. Cl. ..... 208/143; 208/108; 208/161

[58] Field of Search ..... 208/108, 143, 157, 161, 208/162, 424

[56] References Cited

U.S. PATENT DOCUMENTS 2,313,940 3/1943 Hirsch ..... 208/157 X
3,600,300 8/1971 Steenberg ..... 208/108
3,622,495 11/1971 Gatsis et al. ..... 208/108 X
4,040,958 8/1977 Rammler ..... 210/770
4,285,804 8/1981 Jacquin et al. ..... 208/143 X
4,610,779 9/1986 Markley et al. ..... 208/143 X
4,778,605 10/1988 Anthoney et al. ..... 210/770

OTHER PUBLICATIONS

Perry's Chemical Engineers' Handbook, Sixth Edition, Section 20.

*Primary Examiner*—Curtis R. Davis
*Assistant Examiner*—William Diemler
*Attorney, Agent, or Firm*—Frishauf, Holtz, Goodman & Woodward

[57] ABSTRACT

The present invention relates to a process for hydrogenating a heavy oil in a hydrogenation reactor of the suspension bed type by the use of catalyst particles and subjecting a catalyst slurry consisting of the used catalyst and the product oil withdrawn from the hydrogenation reactor to solid/liquid separation to recover the product oil and then regenerating by oxidation the used catalyst, the improvement being that the solid/liquid separation step includes at least a step of heat drying oil-containing catalyst particles.

In accordance with the process of the present invention, the rate of recovery of oil in the catalyst slurry is high and the yield of product oil can be increased.

10 Claims, 6 Drawing Sheets

PROCESS FOR HYDROGENATION OF HEAVY OIL

BACKGROUND OF THE INVENTION

The present invention relates to a process for hydrogenation of heavy oil and more particularly to a process for hydrogenation of heavy oil in which the recovery of oil from a catalyst slurry consisting of a used catalyst and product oil as withdrawn from a hydrogenation reactor is increased and thus the yield of product oil is high.

A method of hydrogenating hydrocarbons such as heavy oil by the use of a fine particle catalyst in which the catalyst slurry obtained by the hydrogenation is subjected to solid liquid separation by the use of a catalyst separator such as a centrifugal separator, a hydrocyclone, a filter and the like to separate the product oil and a used catalyst containing an oil fraction is regenerated by burning and recycled for reuse has been known as described in Japanese Patent Publication No. 11354/1982. The fine particle catalyst used in the above method has a large surface area as compared with a pelletized or tableted catalyst and, therefore, a reduction of catalytic activity due to deposition of carbon or metal is decreased and particularly a reduction of catalytic activity due to deposition of metal is effectively prevented. It is also known that the fine particle catalyst can be easily mixed with heavy oil and uniformly distributed in a reactor and furthermore the exchange of the catalyst in the reactor can be easily carried out in the slurry condition and, therefore, hydrogenation of heavy oil can be carried out stably over a long term. In order to carry out the stable reaction over a long term, however, it is necessary to supply a makeup catalyst of high activity or a regenerated catalyst, and further to withdraw the used catalyst. The used catalyst is withdrawn as a catalyst slurry along with the product oil. In the above method, however, the oil contained in the catalyst slurry is recovered only insufficiently.

When a solid/liquid separator such as a centrifugal separator and a hydrocyclone is used, although the recovery rate of the catalyst particles is high, it is necessary to limit the concentration of the catalyst in a cake discharged from the centrifugal separator or in the underflow of the hydrocyclone to 40 to 70% by weight in order to attain smooth flow of the cake or the underflow (Handbook of Chemical Engineering, Revised 4th Ed., edited by Kagaku Kogaku Kyokai, published by Maruzen Co., Ltd., Japan, pp. 1070–1071). In other words, the fluid, e.g., cake discharged from the centrifugal separator or underflow of the hydrocyclone, contains 30 to 60% by weight of product oil but not recovered. This oil is burned in the presence of oxygen at the subsequent catalyst oxidation regeneration step and cannot be recovered, leading to a decrease in the yield of product oil.

That is, in the conventional suspension bed-type hydrogenation process using a powdery catalyst, the recovery and regeneration of the catalyst particle is sufficiently satisfactory, but the recovery of product oil entrained by the catalyst particle is not sufficiently high and the yield of product oil is low.

SUMMARY OF THE INVENTION

In hydrogenation of heavy oil, it has been found that if at least a heat drying step is provided as one step for solid/liquid separation in order to recover product oil entrained by catalyst particles, product oil conventionally burned can be recovered and thus the yield of product oil can be increased.

The present invention relates to a process for hydrogenating a heavy oil in a hydrogenation reactor of the suspension bed type by the use of catalyst particles and subjecting a catalyst slurry consisting of the used catalyst and the product oil withdrawn from the hydrogenation reactor to solid/liquid separation to recover the product oil and then regenerating by oxidation the used catalyst, the improvement is that the solid/liquid separation step includes at least a heat drying step of oil-containing catalyst particles.

Figure 1:
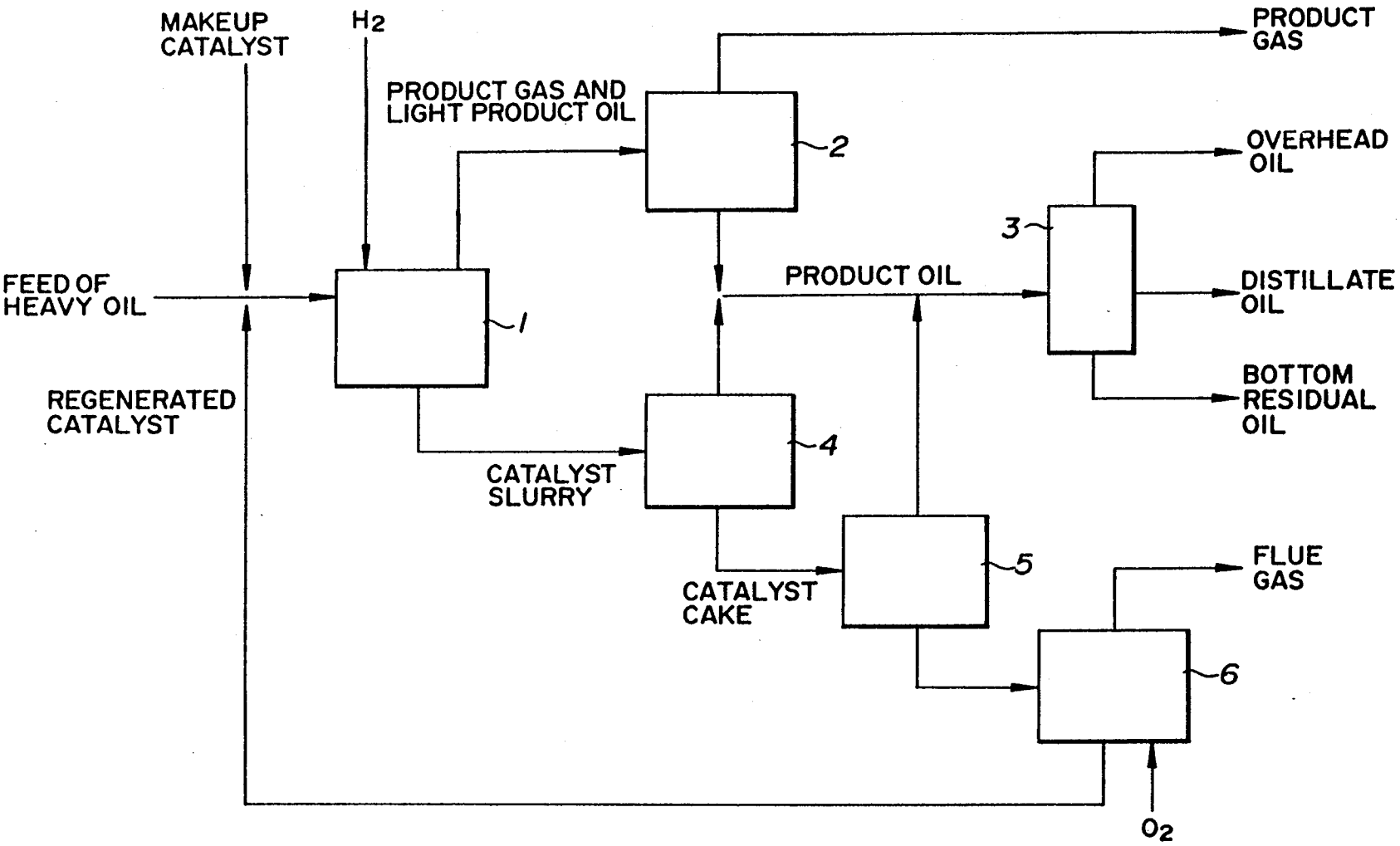
FIG. 1 is a flow diagram showing one embodiment of the process of the present invention.

The reference numerals indicate the following parts.

1—Hydrogenation reactor, 2—Gas/liquid separator, 3—Distillation column, 4—Solid/liquid separator, 4A—Hydrocyclone, 4B—Horizontal type centrifugal decantor, 5—Heat drier, 5A—Conductive heating type drier, 5B—Spray drier, 5C—Riser, 6—Oxidative regenerator.

DETAILED DESCRIPTION OF THE INVENTION

The present invention will hereinafter be explained with reference to the accompanying drawings.

FIG. 1 is a flow diagram showing one embodiment of the process of the present invention.

In accordance with the process of the present invention, a feed of heavy oil is introduced in a suspension bed-type hydrogenation reactor 1 where it is hydrogenated by the use of catalyst particles. As the heavy oil to be used as the feed in the process of the present invention, any oils commonly used in the usual hydrogenation reaction can be used. Specific examples are heavy hydrocarbon oils such as an atomospheric tower bottom residual oil, a vacuum tower bottom residual oil, oil-sand-bitumen, coal liquefied oil and the like. The catalyst to be used in the reaction is not critical, and any catalysts for hydrogenation can be used. Usually, silica, alumina or zeolite catalysts with metals such as nickel, vanadium, cobalt, molybdenum, iron and the like supported thereon are used, and the particle diameter of the catalyst is preferably 10 to 500 $\mu$m.

More specifically, as the hydrogenation catalyst, a spent fluid catalytic cracking catalyst containing nickel and vanadium, and having been used (hereinafter referred to as a "spent FCC catalyst") as described in U.S. Pat. Nos. 4,048,057 and 4,082,648 is preferably used. In a series of catalyst regeneration and recovery steps such as solid/liquid separation by heat drying and oxidation regeneration, the spent FCC catalyst is excellent in heat resistance and attrition resistance. It is only slightly changed in physical properties such as pore volume, surface area, particle diameter and the like, because it is a catalyst originally designed for use in the above steps.

Moreover, the spent FCC catalyst is inexpensive and has a sufficiently high hydrogenation ability because it contains nickel and vanadium. In order to make the spent FCC catalyst sufficiently exhibit its capabilities such as de-asphalting, de-metaling and the like, the amount of nickel and vanadium is preferably at least 0.5% by weight based on the weight of catalyst. When the metal amount is insufficient, other metals can be supported by the conventional method, if necessary. In this case, nickel and vanadium, cobalt, molybdenum and the like as described above can be used. The total amounts of these metals is preferably at least 0.5% by weight.

The catalyst to be used in the process consists of a makeup catalyst to be added in order to maintain the catalyst amount at a predetermined level and a regenerated catalyst having been subjected to oxidative regeneration by a method as described hereinafter. Hydrogen is added to the heavy oil feed and the particle catalyst, and hydrocracking is carried out in the hydrogenation reactor 1. The reaction temperature is 350° to 500° C. and preferably 400° to 480° C.; the reaction pressure is 10 to 300 kg/cm$^2$G and preferably 50 to 150 kg/cm$^2$G; hydrogen/feed oil ratio is 300 to 3,000 Nm$^3$/Kl and preferably 500 to 2,000 Nm$^3$/Kl; and liquid hourly space velocity (LHSV) is 0.1 to 2 hr$^{-1}$ and preferably 0.1 to 1 hr$^{-1}$.

Then, gas/liquid separation is carried out in the hydrogenation reactor 1. A flow containing product gas and light product oil as produced above is withdrawn from the top of the hydrogenation reactor 1, and a catalyst slurry containing the used catalyst and heavy product oil as produced above is withdrawn from the bottom or side of the hydrogenation reactor 1. Conducting the gas/liquid separation in the hydrogenation reactor 1 substantially increases the concentration of the catalyst in the hydrogenation reactor 1 and at the same time, decreases the amount of the product oil to be sent to a solid/liquid separation step, thereby producing the economical effect that the solid/liquid separation step can be decreased in capacity.

The flow containing product gas and light product oil as withdrawn above is introduced in a gas/liquid separator 2 where the product gas and the light product oil are separated from each other. The light product oil thus separated is introduced in a distillation column 3, if necessary.

The catalyst slurry containing the used catalyst and heavy product oil is subjected to solid/liquid separation.

The present invention is characterized in that at least heat drying is carried out as the solid/liquid separation step. That is, it suffices that the solid/liquid separation step includes at least a heat drying means. This means that the solid/liquid separation step may be only the heat drying means, or it may be a combination of the heat drying means and other solid/liquid separation means.

Usually, the catalyst slurry is introduced in a solid/-liquid separation apparatus 4 comprising a centrifugal separator, a hydrocyclone and the like, where it is subjected to preliminary solid/liquid separation. It suffices that the solid/liquid separation operation is carried out depending on the concentration of the used catalyst in the catalyst slurry, and thus it may be omitted depending on the concentration of the used catalyst in the catalyst slurry. That is, when the concentration of the used catalyst in the catalyst slurry withdrawn from the hydrogenation reactor 1 is markedly low, or when the catalyst slurry is diluted by adding a distillate from the distillation column 3 for the purpose of e.g., stabilizing the product oil, it suffices that after the product oil and diluting oil are recovered by applying preliminary solid/liquid separation, the resulting slurry is sent to the subsequent step (heat drying).

The catalyst slurry comprising the used catalyst and the heavy product oil is introduced in a heat drier 5 without applying the preliminary solid/liquid separation, or alternatively the catalyst slurry is subjected to the preliminary solid/liquid separation, and a little oil-containing catalyst particles, that is, the catalyst cake thus obtained is introduced in the heat drier 5 where it is heat dried to recover the residual oil.

This heat drying means is a step at which the oil contained in the catalyst slurry or in the catalyst particles (catalyst cake) including a small amount of oil is evaporated and separated by applying heat energy to thereby achieve solid/liquid separation. As the heat drier as used herein, various known driers can be used. More specifically, heating type driers such as a feed stationary-type or feed convey-type drier, a feed agitating-type drier, a hot gas convey-type drier and a contact heating-type drier as described in "Drying Apparatus Manual", edited by Nippon Funtai Kogyo Kyokai Co., Ltd and published by Nikkan Kogyo Shinbun Co., Ltd., pp. 27–152 can be used.

Of these driers, taking into consideration the properties of the catalyst and oil, the cost and so forth, a conductive heating-type drier which is of the feed low speed agitating-type, and a spray drier which is of the hot gas convey-type are suitable.

The conductive heating-type drier as used herein means an apparatus in which drying is carried out by conduction from the heated surface, as described in Ryozo Kirisakae ed., "Drying Apparatus", Nikkan Kogyo Shinbun Co., Ltd., p. 311. The feed agitating-type drier is such that the feed is agitated on the heated surface, and is one type of conductive heating-type drier.

The conductive heating-type drier is effective for heating drying the catalyst cake subjected to solid/liquid separation by the use of a solid/liquid separation apparatus such as a centrifugal separator to such an extent that the oil content is as relatively low as about 10 to 60% by weight. In this drier, the catalyst cake is dried in a stream of inert gas or superheated steam at a temperature of 150° to 300° C. for a residence time of 0.25 to 5 hours. The features of the conductive heating-type drier are that the conductive area is large because the agitating blade itself is designed to constitute the conductive surface and thus heat is effectively used, and further the drier is small sized and thus desirable from an economic standpoint. The catalyst cake is uniformly dried by controlling the agitating speed to such a low level that the outer-peripheral speed is about 0.05 to 2 m/sec. Almost no particle aggregation occurs, and troubles such as powdering of the catalyst particle due to attrition are seldom encountered. The reason why the drying temperature is specified to the range of 150° to 300° C. is that if the drying temperature is below 150° C., drying is markedly retarded depending on the properties of the oil, while on the other hand if it is above 300° C., coking occurs on the conductive heated surface and the operation of the apparatus becomes difficult and, furthermore, the yield of oil is decreased. The oil evaporated by the drier is condensed by cooling and recovered as a product oil. On the other hand, the catalyst freed of the oil does not substantially contain oil and can be sent to an oxidative regenerator 6 for oxidative regeneration by the use of the conventional feeding equipment.

The spray drier is described in the aforementioned "Drying Apparatus" (published by Nikkan Kogyo Shinbun Co., Ltd.), and is an apparatus for drying by spraying the catalyst slurry in a high temperature gas stream. The spray drier has a feature that facilitates drying in a short time, e.g., in several seconds.

The spray drier is suitable for recovering oil by heat drying from a catalyst cake having as relatively high oil content as about 50 to 95% by weight as obtained by the preliminary solid/liquid separation apparatus using the hydrocyclone and the like, or a catalyst slurry having fluidity. The catalyst slurry subjected to solid/liquid separation is sprayed in the spray drier and is subjected to heat exchange countercurrently or in parallel with hot gas or superheated steam to evaporate the oil. In this oil recovery, taking into consideration the subsequent separation of oil and heat medium, it is preferred that superheated steam be used. This drying is necessary to be completed usually in as short a contact time as about one to several seconds and, therefore, it needs a large amount of a heat source and the volume of the drier is necessary to make large. Drying of the heavy oil is desirably carried out at a temperature of 350° to 500° C. for a contact time of 1 to 10 seconds, because the heat capacity coefficient of the heavy oil is low. In the spray drier, troubles such as powdering of the catalyst and the like seldom occur, because no agitation operation is conducted and, therefore, stable operation is realized. As the heat source for the spray drier, the heat contained in a high temperature catalyst regenerated in an oxidative regenerator 6 as described hereinafter can be used by heat exchanging directly or indirectly with inert gas or superheated steam.

The catalyst after heat drying in the spray drier may be sent to an oxidative regenerator 6 by the use of the conventional feed means such as a screw feeder and the like, or it may be conveyed by utilizing the difference in pressure as produced by providing the spray drier just above the oxidative regenerator 6 and connecting the spray drier to the oxidative regenerator 6 by the use of a stand pipe.

Although the heat drying means is explained above referring to the conductive heating-type drier and the spray drier, other heat driers such as a contact heating-type drier, a feed convey-type drier and the like can be used in the present invention under nearly the same conditions as in the conductive heating-type drier and the spray drier.

Figure 2:
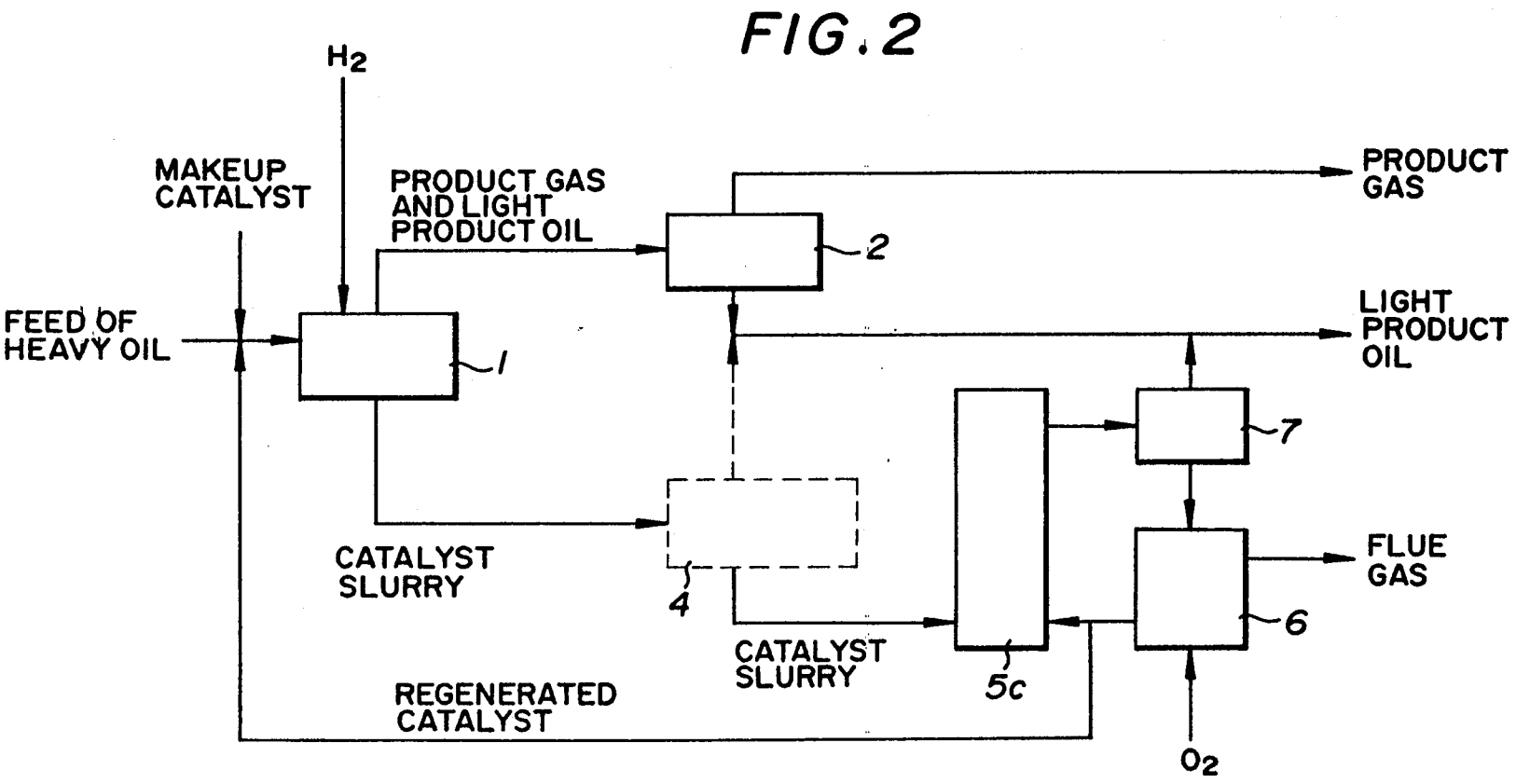
FIG. 2 is a flow diagram showing another embodiment of the process of the present invention in which a riser is used.

As well as the above heat drying methods, there can be used a rise-type heat drying method (hereinafter referred to as the "riser method") which permits efficient use of coke combustion heat in the oxidative regenerator 6, although not described in "Drying Apparatus Manual" as described above. This riser method requires an oxidative regenerator 6 as described hereinafter. The flow diagram of the process of the present invention when the riser method is employed is shown in FIG. 2.

The riser to be used in the riser method is the same as the riser to be used at the riser cracking-type fluid catalytic cracking step in the so-called fluid catalytic cracking unit of petroleum refining, as described in Yoshikazu Kawase et al., ed., "Handbook of Oil Refinery Technology", 3rd ed., Sangyo Tosho Co., pp. 57–62.

In the riser method, a regenerated catalyst of high temperature as obtained by burning coke on the used catalyst in the oxidative regenerator 6 is withdrawn from the bottom or side of the oxidative regenerator 6 and introduced in a piping (riser) 5C extending upward toward a stripper 7, in which the regenerated catalyst of high temperature is contacted with the used catalyst slurry withdrawn from the reactor or if necessary, after preliminary solid/liquid separation in the solid/liquid separation apparatus 4 to thereby heat dry the used catalyst slurry with the heat contained in the regenerated catalyst.

The concentration of the catalyst in the catalyst slurry is 5 to 50% by weight and preferably 15 to 50% by weight. If the concentration of the catalyst in the catalyst slurry is less than 5% by weight, oil content in the catalyst slurry is too large and, therefore, it is preferred for the catalyst slurry to be fed to the riser 5C after increasing the concentration of the catalyst in the catalyst slurry by subjecting the catalyst slurry to preliminary solid/liquid separation by the use of e.g., the aforementioned hydrocyclone in order to increase the oil recovery rate. On the other hand, if the concentration of the catalyst is in excess of 50% by weight, the catalyst slurry causes plugging of a riser feed line, and uniform introduction of the catalyst slurry in the inside of the riser becomes difficult, and the stable riser operation cannot be carried out. In the case that the catalyst slurry is subjected to preliminary solid/liquid separation by the use of e.g., a centrifugal decantor to form the so-called catalyst cake having a low oil content or high catalyst content(more than 70% by weight), the resulting catalyst cake can be fed to the riser 5C after increasing the dispersibility of the catalyst cake by the use of a known crusher or feeder.

The used catalyst slurry introduced in the riser 5C is contacted with the regenerated catalyst of high temperature as regenerated in the oxidative regenerator 6 to thereby vaporize the oil utilizing the heat contained in the regenerated catalyst, and the used catalyst with only dry coke thereon rises in the riser 5C and enters the stripper 7. The ratio of the regenerated catalyst to the used catalyst slurry being fed to the riser 5C is controlled so that the weight ratio of the content of the regenerated catalyst to the content of oil in the used catalyst slurry is 1:1 to 30:1 and preferably 3:1 to 20:1. More specifically, the ratio is determined depending on the heat value of the requirement for evaporation and recovery of the oil and the temperature of the riser. If the above ratio is too small, the contact frequency between the oil in the used catalyst slurry and the regenerated catalyst is decreased and the heat value of the requirement for heat drying cannot be supplied, as a result of which the recovery of the oil is decreased and furthermore troubles such as poor circulation in the riser are caused, and thus the stable riser operation cannot be carried out.

On the other hand, if the above ratio is too large, the linear velocity of catalyst particles in the riser is increased and thus the catalyst particle is powdered by attrition, or as the above ratio is increased, the amount of coke production is increased but to a small extent, as a result of cracking.

The temperature of the riser is usually 350° to 520° C. and preferably 380° to 500° C., although it varies depending on the properties of the oil in the catalyst slurry. If the temperature is less than 350° C., vaporization and drying of the oil in the catalyst slurry are only insufficient. On the other hand, if the temperature is more than 520° C., the cracking reaction readily occurs, leading to an increase in the amount of coke production and a decrease in the rate of recovery of oil. In order to decrease the oil partial pressure, superheated steam and the like can be introduced, whereby the recovery of oil is increased. The contact time of the oil in the catalyst slurry with the regenerated catalyst in the riser is not critical, but usually from 0.5 to 20 seconds.

The catalyst slurry which contains evaporated oil, rises upwardly through the riser 5C along with the regenerated catalyst and enters the stripper 7. The recovered oil and the introduced steam if necessary are withdrawn from the top of the stripper 7 and, if necessary, are cooled and condensed in a condenser 8 and separated into oil and water. The oil is recovered as the product oil and sent to a distillation column if necessary. In this case, depending on conditions, the vaporized oil and water can be sent to the distillation column without passing through the condenser. The used catalyst from which oil has been evaporated and removed and the regenerated catalyst are sent from the stripper 7 through a stand pipe to the oxidative regenerator 6 where they are regenerated in the presence of oxygen and, thereafter, the regenerated catalyst is returned to the riser 5C. In this manner, the regenerated catalyst is recycled through the riser, the stripper and the oxidative regenerator 6.

As described above, the used catalyst from which oil has been recovered at the heat drying step is sent to the oxidative regenerator 6 and regenerated by oxidation using oxygen.

The regeneration conditions are not critical. The temperature is 500° to 750° C. and preferably 550° to 650° C., the pressure is atmospheric pressure to 10 $kg/cm^2G$ and preferably atmospheric pressure to 5 $kg/cm^2G$, and the oxygen concentration in the feed gas is 5 to 21% (supply base).

A part of the regenerated catalyst in the oxidative regenerator 6 is sent to the heat drier 5, e.g., a riser, where it is used as a heat source, and the other part of the regenerated catalyst is recycled to the hydrogenation reactor 1 and used in the reaction. In order to maintain the catalytic activity, it is possible that the used catalyst is withdrawn and the makeup catalyst is supplemented. The oil recovered by heat drying at the heat drying step is distilled in the distillation column 3 along with the light product oil withdrawn from the top of the hydrogenation reactor 1 or the product oil without the catalyst as obtained at the preliminary solid/liquid separation step using, for example, a hydrocyclone as provided if necessary. The distillate from the distillation column 3 can be blended with the catalyst slurry withdrawn from the hydrogenation reactor 1 and used as a dilution oil as described above.

In the case of the riser method, the oil as obtained by heat drying in the riser 5C and recovered by the stripper 7 can be distilled in its exclusive distillation column and used as a dilution oil for the catalyst slurry withdrawn from the hydrogenation reactor 1 if necessary.

By recycling active fine catalyst particles as described above, the stable hydrocracking reaction of heavy oil can be carried out over a long term.

In accordance with the process of the present invention, the rate of recovery of oil in the catalyst slurry is high and the yield of product oil can be increased.

In the process of the present invention, drying is carried out under relatively mild conditions, or the heat generated at the regeneration of the catalyst can be utilized and, therefore, utility costs are low and the operation can be easily carried out.

Furthermore, catalyst particles are less powdered at the solid/liquid separation step and the catalyst can be used efficiently and, therefore, the process of the present invention is useful for hydrogenation of heavy oils and the like, or for liquefication of coal and the like.

The present invention is described in greater detail with reference to the following examples.

EXAMPLE 1

Figure 3:
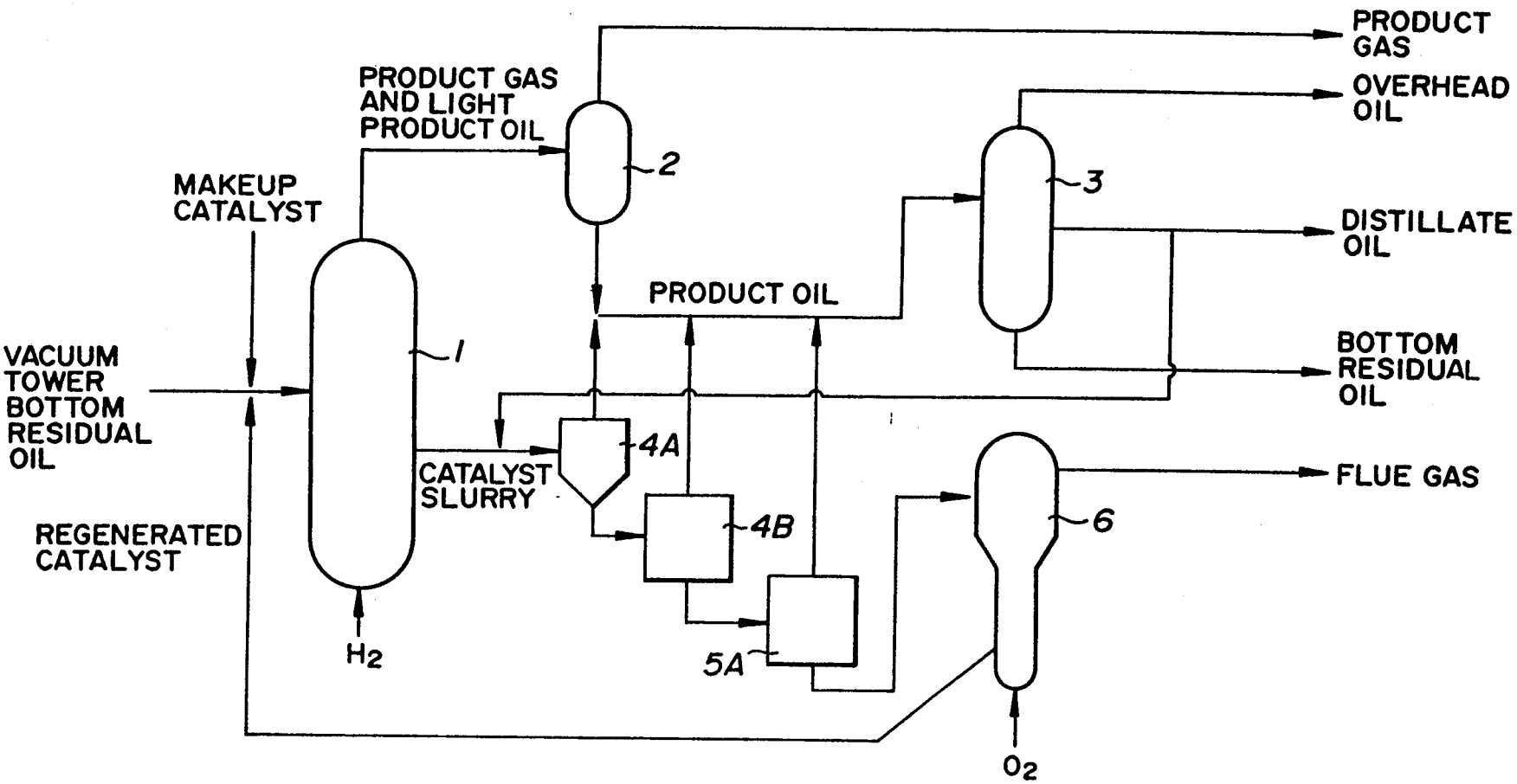
FIG. 3 is a flow diagram of Example 1.

The process according to the flow diagram shown in FIG. 3 was operated and product oil was produced and used catalyst was regenerated.

(1) Properties of Feed Oil and Catalyst

Vacuum tower bottom residual oil having the properties as shown in Table 1 was used for feed oil.

TABLE 1

| | |
|---|---|
| Distillation | 525° C.+ fraction 96.4 wt % |
| Specific Gravity | 1.0342 |
| Sulfur Content | 5.01 wt % |
| Nitrogen Content | 3,240 wt ppm |
| Metal Content V/Ni | 116/33 wt ppm |
| Conradson Carbon Residue | 19.5 wt % |

As the hydrogenation catalyst, a silica/alumina/zeolite catalyst with nickel and vanadium supported thereon by the known method, having properties as shown in Table 2 was used.

TABLE 2

| | |
|---|---|
| Supported Metal V/Ni | 1.0/0.5 wt % |
| Surface Area | 281 $m^2/g$ |
| Pore Volume | 0.33 ml/g |
| Apparent Bulk Density (A.B.D) | 0.66 g/ml |
| Average Particle Diameter | 66 μm |

(2) Hydrogenation

Using a flow type suspension-bubble column reactor (inner diameter: 25 cm; height: 400 cm) as the hydrogenation reactor 1, the above vacuum tower bottom residual oil was hydrogenated. Reaction conditions were such that the hydrogen partial pressure was 63 $kg/cm^2G$, the liquid hourly space velocity was 0.5 $hr^{-1}$, the reaction temperature was 440° C., and the hydrogen/oil ratio was 700 $NM^3/Kl$. Gas/liquid separation was carried out in the hydrogenation reactor 1, and the product gas and light product oil were withdrawn from the top of the hydrogenation reactor 1 and a catalyst slurry comprising the used catalyst and heavy product oil, from the side of the reactor 1.

(3) Preliminary Solid/Liquid Separation

For the purpose of stabilizing the product oil, a fraction having the boiling point range of 232° to 343° C. of the product oil from the distillation column 3 was added to and mixed with the above catalyst slurry, the weight ratio of said fraction to catalyst slurry being 1:1, to control the oil properties.

The catalyst slurry was subjected to preliminary solid/liquid separation using a hydrocyclone 4A comprising a first hydrocyclone (inner diameter: 25 mm) and a second hydrocyclone (inner diameter: 10 mm), the ratio of overflow to underflow being 2.0:1 to obtain an overflow substantially not containing catalyst particles and an underflow containing concentrated catalyst particles.

The underflow of hydrocyclone was subjected to centrifugal separation at an acceleration of 2,800G by the use of a horizontal centrifugal decantor 4B to separate clarified oil not containing catalyst particles and a catalyst cake consisting of used catalyst particles and oil.

(4) Heat Drying

The catalyst cake thus obtained was introduced in a conductive heating-type drier 5A having a volume of 50 liters and a conductive heating surface area of 1.6 $m^2$ and the oil was recovered at a temperature of 200° C. under atmospheric pressure for a residence time of 2 hours to obtain the dried catalyst cake with little containing oil. The oil content of the catalyst cake supplied to the heat drier was 17.8% by weight while on the other hand the oil content of the catalyst cake after drying was decreased to 1.70% by weight.

(5) Catalyst Regeneration

The dried catalyst cake was introduced in a fluid bed-type oxidative regenerator 6 having an inner diameter of 27 cm and a height of 400 cm, where catalyst regeneration was carried out at a temperature of 630° C. under a regeneration pressure of 1.5 $kg/cm^2G$ and at an oxygen concentration of 12% by volume (nitrogen gas concentration: 88% by volume). In the regenerated catalyst thus obtained, the amount of coke on the regenerated catalyst was not more than 0.2% by weight based on the weight of the catalyst, and the regenerated catalyst was recycled to the hydrogenation reactor 1 and again used for the hydrogenation reaction.

The light product oil obtained at the hydrogenation step, the overflow from the hydrocyclone 4A, the clarified oil from the horizontal centrifugal decantor 4B, and the vaporized and recovered oil from the conductive heating-type drier 5A were introduced in the distillation column 3 where they were separated into a overhead oil, a distillate oil and a bottom residual oil. A part of the distillate oil was fed back to the preliminary solid/liquid separation step to control the properties of the catalyst slurry and product oil.

The yield of each product obtained after the steady operation of each apparatus is shown in Table 3.

EXAMPLE 2

Figure 4:
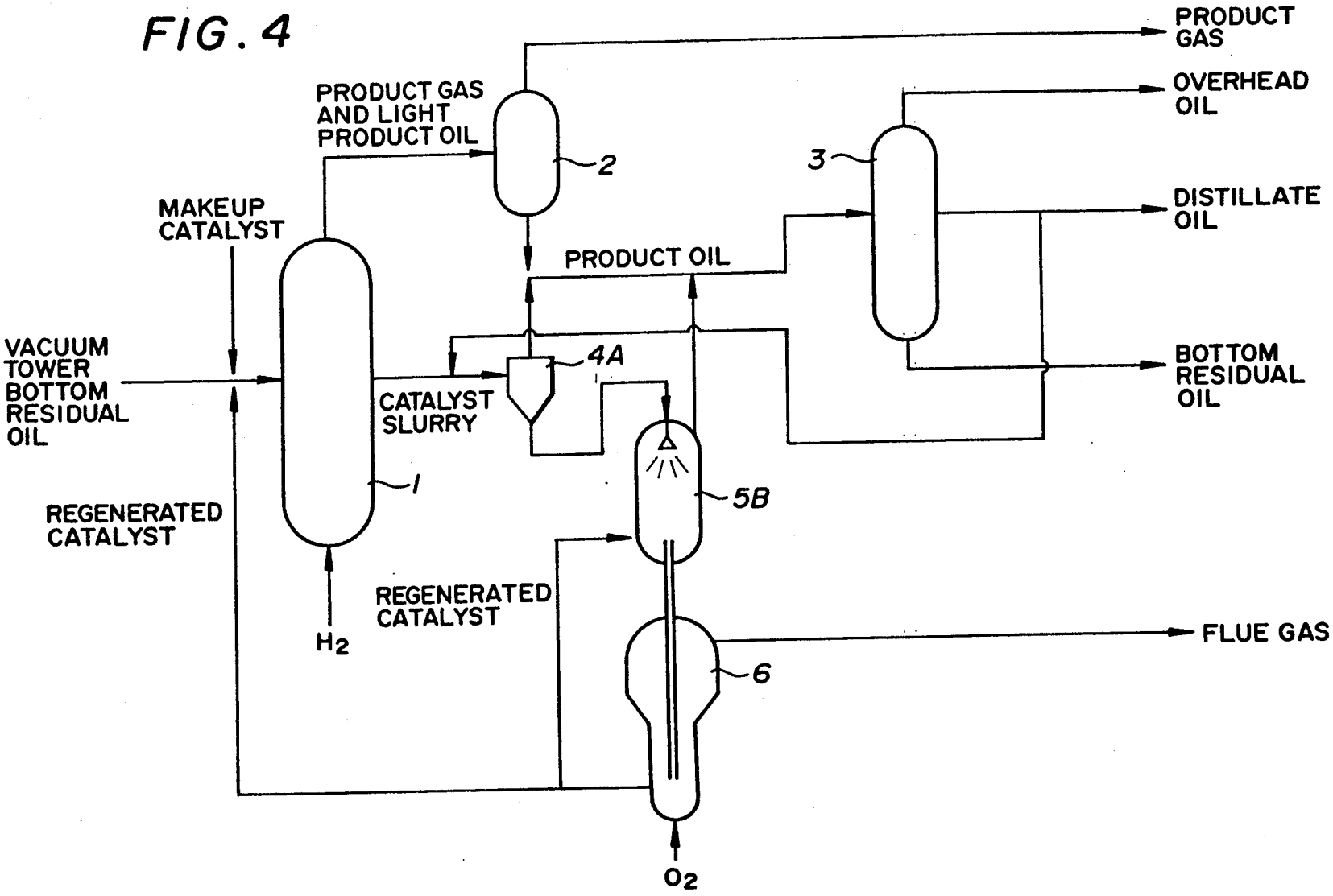
FIG. 4 is a flow diagram of Example 2.

The process according to the flow diagram shown in FIG. 4 was conducted. That is, the hydrogenation reaction was carried out, the gas/liquid separation was carried out, and the catalyst slurry was subjected to preliminary solid separation in the hydrocyclone 4A, all in the same manner as in Example 1. The underflow from the hydrocyclone 4A was introduced in the spray drier 5B.

The spray drier 5B had an inner diameter of 88 cm and a height of 400 cm, and drying was carried out under conditions of drying temperature 440° C., pressure 1.3 $kg/cm^2G$, residence time 15 minutes to recover oil, which was then introduced in the distillation column 3. On the other hand, the used catalyst from which the oil had been recovered was introduced through the standpipe in the oxidative regenerator 6 where it was regenerated.

A part of the regenerated catalyst was recycled to the spray drier 5B to use as a heat source of drying.

The product oil thus obtained was introduced in the distillation column 3 and separated into an overhead oil, a distillate oil and a bottom residual oil in the same manner as in Example 1. A part of the distillate oil was fed back to the hydrocyclone 4A to control the properties of the catalyst slurry and product oil.

The yield of each of the products after the steady operation of each apparatus is shown in Table 3.

COMPARATIVE EXAMPLE 1

Figure 5:
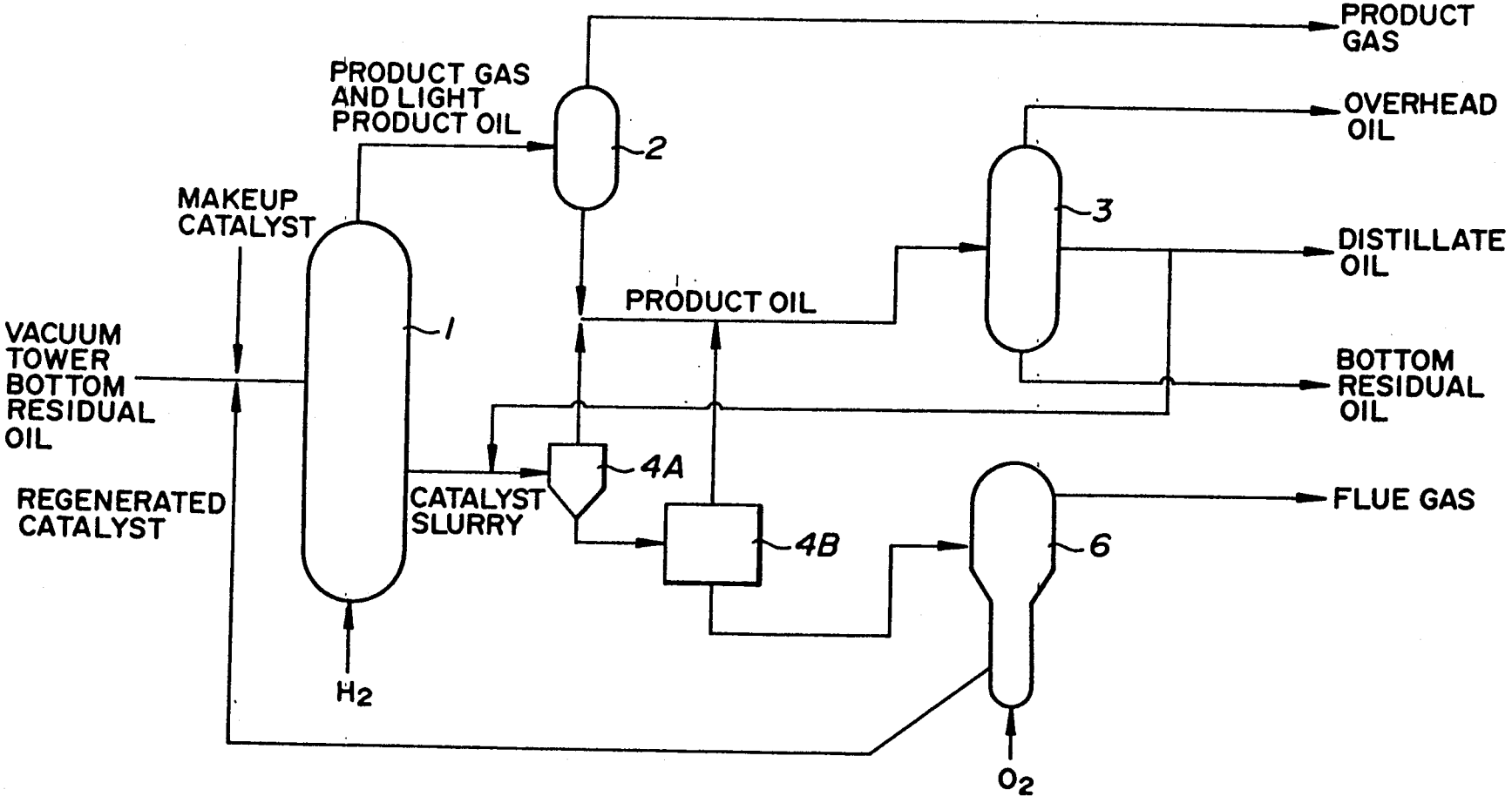
FIG. 5 is a flow diagram of Comparative Example 1.

The procedure of Example 1 was repeated with the exception that the heat drying step was not provided as the Comparative Example 1; in other words, the heat drier 5A was not provided and catalyst cake from horizontal centrifugal decantor 4B was introduced in oxidative regenerator 6 directly and regenerated; and the regenerated catalyst was recycled to the hydrogenation reactor 1 to reuse for the hydrogenation reaction again. The flow diagram is shown in FIG. 5. The yield of each product after the steady operation of each apparatus is shown in Table 3.

TABLE 3

| | Example 1 (wt %) | Example 2 (wt %) | Comparative Example 1 (wt %) |
|---|---|---|---|
| $C_1$ to $C_4$ | 4.7 | 4.7 | 4.7 |
| $H_2S + NH_3$ | 1.8 | 1.8 | 1.8 |
| $C_5$ to 171° C. Fraction | 8.9 | 8.8 | 8.8 |
| 171-343° C. Fraction | 26.5 | 26.2 | 25.6 |
| 343-525° C. Fraction | 31.5 | 30.9 | 30.1 |
| 525° C.+ Fraction | 24.2 | 23.8 | 23.3 |
| Total Oil Yield ($C_5$+ Fraction) | 91.1 | 89.7 | 87.8 |
| Combustion Amount in Oxidative Regenerator | 3.4 | 4.8 | 6.7 |

(wt % based on the weight of feed oil supplied)

It can be seen from the results of Table 3 that the yields of $C_5$ or heavier oil in the examples are higher than that in Comparative Example 1, and that particularly when a conductive heating-type drier is used as in Example 1, the yield of $C_5$ or heavier oil is higher than that in Comparative Example 1 by about 3% by weight.

The $C_5$ or heavier oil yield in Example 2 is somewhat lower than that in Example 1. The reason for this is that the concentration of the catalyst in the catalyst slurry to be fed to the spray drier cannot be increased. As compared with Comparative Example 1, Examples 1 and 2 show higher oil yield.

EXAMPLE 3

(1) Properties of Feed Oil and Catalyst

Figure 6:
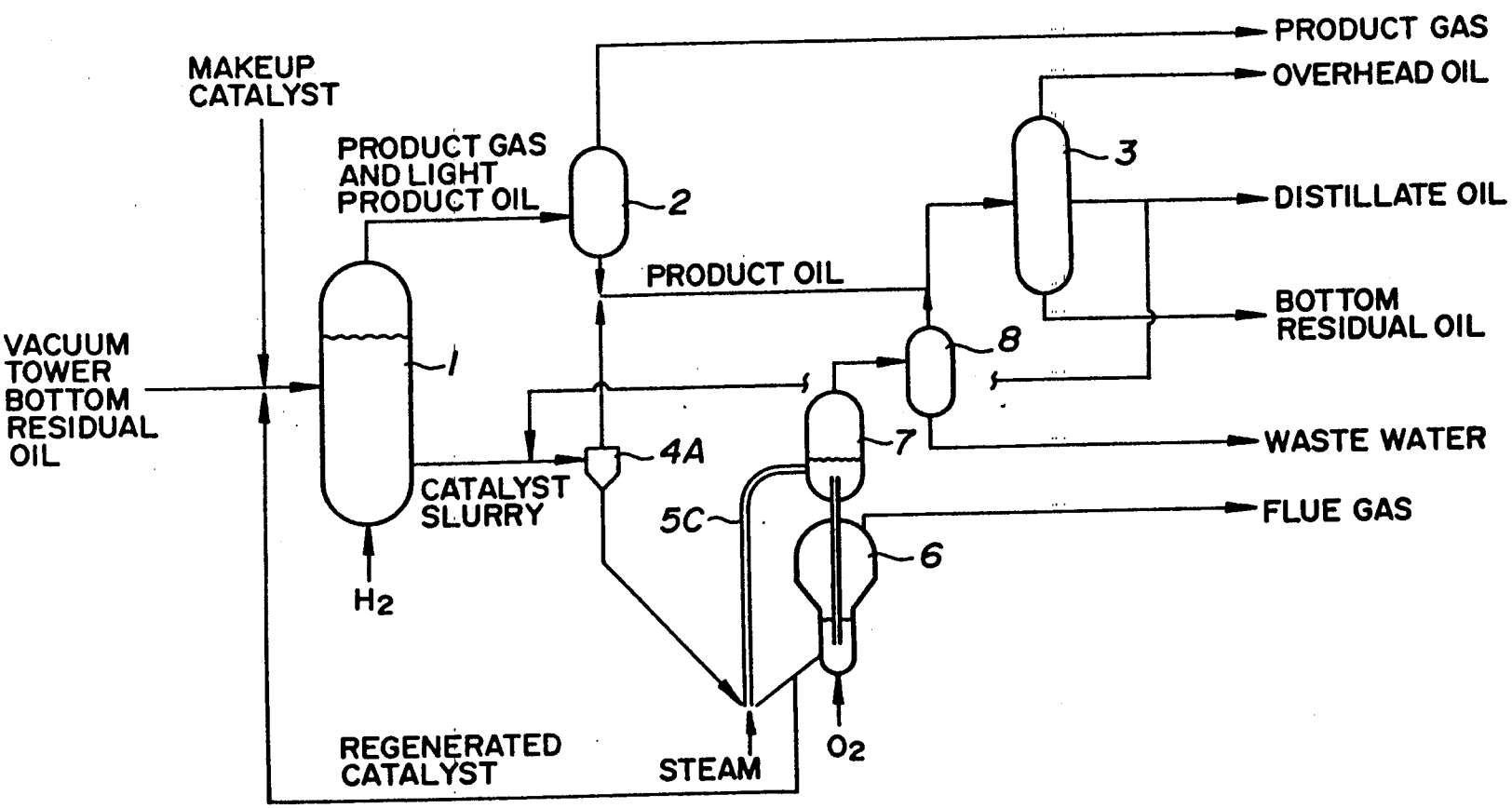
FIG. 6 is a flow diagram of Example 3.

The process according to the flow diagram shown in FIG. 6 was conducted. The same feed oil as in Example 1 was used, and as the hydrogenation catalyst, a catalyst prepared by supporting nickel and vanadium on the spent FCC catalyst (MRZ204, silica-alimina-zeolite-based, produced by Catalysts & Chemicals Ind. Co., Ltd.) by the known method and having the physical properties shown in Table 4 was used.

TABLE 4

| | |
|---|---|
| Supported Metals V/Ni | 2.2/1.2 wt % |
| Surface Area | 69 $m^2/g$ |
| Pore Volume | 0.09 ml/g |
| Apparent Bulk Density (A.B.D) | 0.90 g/ml |
| Average Particle Diameter | 62 μm |

(2) Hydrogenation and (3) Preliminary Solid/Liquid Separation

The hydrogenation and the preliminary solid/liquid separation using the hydrocyclone 4A were carried out in the same manner as in Example 1, but the horizontal centrifugal decantor was not used and the underflow slurry from the hydrocyclone was introduced directly in the riser 5C.

(4) Heat Drying in Riser

The riser 5C had an inner diameter of 3.8 cm and a height of 10 m, and heat drying was carried out under conditions of drying temperature 420° C., pressure 1.3 kg/cm$^2$G, regenerated catalyst/oil in the catalyst slurry ratio = 8/1 and contact time 2 seconds. For the purpose of decreasing the oil partial pressure, superheated steam was introduced in a proportion of 15% by weight based on the weight of the oil in the catalyst slurry.

The oil evaporated through contact with the regenerated catalyst of high temperature in the riser 5C was introduced in the stripper 7 along with the used catalyst and after separation from the used catalyst, was withdrawn from the top of the stripper 7. The oil was condensed in the condenser 8 and after oil/water separation in the separator, and sent to the distillation column 3. The water was sent to the waste water treatment step. As a result, 96% by weight of the oil contained in the catalyst slurry supplied to the riser 5C was separated and recovered by heat drying.

(5) Catalyst Regeneration

The used catalyst in the stripper 7 from which oil had been removed and the recycling regenerated catalyst were sent through the standpipe connected to the oxidative regenerator 6 to the oxidative regenerator 6. The oxidative regenerator 6 was of the fluid bed type and had an inner diameter of 27 cm and a height of 400 cm, and the catalyst containing coke was burned under conditions of regeneration temperature 630° C., regeneration pressure 1.5 kg/cm$^2$G and inlet oxygen concentration 12% by volume to carry out catalyst regeneration.

The major portion of the regenerated catalyst was again introduced in the riser 5C and used to heat dry the catalyst slurry. A part of regenerated catalyst, however, was recycled to the hydrogenation reaction step and again subjected to hydrogenation. The yield of each product after the operation was stable is shown in Table 5.

COMPARATIVE EXAMPLE 2

The same feed oil and catalyst as in Example 3 were used, and under the same conditions as in Example 3, hydrogenation and preliminary solid/liquid separation of the catalyst slurry using the hydrocyclone was carried out. Then the underflow slurry of hydrocyclone was treated at an acceleration of 2,800G by the use of a horizontal centrifugal decantor to obtain clarified oil not containing catalyst particles and a catalyst cake consisting of the used catalyst and residual oil. The catalyst cake was introduced in the same oxidative regenerator 6 as used in Example 3, by the use of the known feeder, but not by the use of a riser, and the catalyst was regenerated under the same conditions as in Example 3 and then returned to the hydrogenation reaction step and reused. The yield of each product after the operation was stable as shown in Table 5.

TABLE 5

| | Example 3 (wt %) | Comparative Example 2 (wt %) |
|---|---|---|
| $C_1$ to $C_4$ | 5.1 | 4.9 |
| $H_2S + NH_3$ | 1.7 | 1.7 |
| $C_5$ to 171° C. Fraction | 9.3 | 8.8 |
| 171 to 343° C. Fraction | 27.6 | 25.9 |
| 343 to 525° C. Fraction | 31.3 | 29.2 |
| 525° C.$^+$ Fraction | 22.1 | 23.9 |
| Total Oil Yield ($C_5^+$ Fraction) | 90.3 | 87.8 |
| Combustion Amount in Oxidative Regenerator | 3.9 | 6.6 |

(wt. % based on the weight of the feed oil supplied)

It can be seen that in Example 3, the yield of $C_5$ or heavier oil is high as compared to the yield in Comparative Example 2, and by using the riser type heat drying step, the oil of $C_5$ or heavier oil is recovered in a 2.5% by weight greater amount than that in Comparative Example 2.

What is claimed is:

1. A method for improving the yield of product oil in a process for hydrogenating a heavy oil in a suspension bed hydrogenation reactor having a particulate catalyst, wherein a catalyst slurry comprising used catalyst and product oil is withdrawn from the hydrogenation reactor and subjected to solid/liquid separation using heat drying to recover the product oil, followed by oxidative regeneration of the used catalyst, said heat drying carried out by (a) a conductive heating-type drier at a temperature of 150° to 300° C. for a residence time of 0.25 to 5 hours with an oil content in the catalyst slurry of 10 to 60% by weight, (b) a spray drier at a temperature of 350° to 500° C. for a residence time of 1 to 10 seconds with an oil content in the catalyst slurry of 50 to 95% by weight, or (c) a riser-type drier at a temperature of 350° to 520° C. with a catalyst content in the catalyst slurry of 5 to 50% by weight.

2. The method of claim 1 wherein for riser-type drying the catalyst content in the catalyst slurry is from 15 to 50% by weight.

3. The method of claim 2 wherein heat drying is conducted at a temperature of 380 to 500 degrees C. for a residence time of 0.5 to 20 seconds.

4. The method of claim 1, wherein said heat drying is carried out by a riser type drier and the weight ratio of the content of the catalyst to content of the oil in the slurry fed to the riser is 1:1 to 30:1.

5. The method of claim 1, wherein said heat drying is carried out by a riser type drier and the weight ratio of the content of the catalyst to the content of the oil in the slurry fed to the riser is 3:1 to 20:1.

6. A method for improving the yield of product oil in a process for hydrogenating a heavy oil in a suspension bed hydrogenation reactor having a particulate catalyst, wherein a catalyst slurry comprising used catalyst and product oil is withdrawn from the hydrogenation reactor and subjected to solid/liquid separation to recover the product oil, followed by heat drying the remaining catalyst slurry to recover additional product oil, followed by oxidative regeneration of the used catalyst, said heat drying carried out by (a) a conductive heating-type drier at a temperature of 150° to 300° C. for a residence time of 0.25 to 5 hours with an oil content in the catalyst slurry of 10 to 60% by weight, (b) a spray drier at a temperature of 350° to 500° C. for a residence time of 1 to 10 seconds with an oil content in the catalyst slurry of 50 to 95% by weight, or (c) a riser-type drier at a temperature of 350° to 520° C. with a catalyst content in the catalyst slurry of 5 to 50% by weight.

7. The method of claim 6 wherein said heat drying is carried out by a riser-type drier and the catalyst content in the catalyst slurry is from 15 to 50% by weight.

8. The method of claim 7 wherein heat drying is conducted at a temperature of 380 to 500 degrees C. for a residence time of 0.5 to 20 seconds.

9. The method of claim 6, wherein said heat drying is carried out by a riser type drier and the weight ratio of the content of the catalyst to content of the oil in the slurry fed to the riser is 1:1 to 30:1.

10. The method of claim 6, wherein said heat drying is carried out by a riser type drier and the weight ratio of the content of the catalyst to the content of the oil in the slurry fed to the riser is 3:1 to 20:1.

* * * * *

UNITED STATES PATENT AND TRADEMARK OFFICE

CERTIFICATE OF CORRECTION

PATENT NO. : 5,008,001

DATED : April 16, 1991

INVENTOR(S) : KITAMURA et al

It is certified that error appears in the above-identified patent and that said Letters Patent is hereby corrected as shown below:

TITLE PAGE:

Section [56] References Cited, under "U.S. PATENT DOCUMENTS", insert the following:

4,507,397 3/1985 Buss.....502/38
4,082,648 4/1978 Murphy.....208/97

Under "FOREIGN PATENT DOCUMENTS", insert the following:

DE 3427630 2/1985 Fed. Rep. Germany
11354 3/1982 Japan

Under "OTHER DOCUMENTS", insert the following:

Handbook of Chemical Engineering, Kagaku Kogaku Kykai, Pages 1070-1071 Revised 4th Ed. published by Maruzen Co., Ltd. (1978)

Signed and Sealed this

Second Day of March, 1993

*Attest:*

STEPHEN G. KUNIN

*Attesting Officer*

*Acting Commissioner of Patents and Trademarks*